US005285041A

United States Patent [19]

Wright

[11] Patent Number: 5,285,041

[45] Date of Patent: Feb. 8, 1994

[54] AUTOMATED FOOD VENDING SYSTEM

[75] Inventor: Christopher B. Wright, San Francisco, Calif.

[73] Assignee: Wright Food Systems, Inc., San Francisco, Calif.

[21] Appl. No.: 944,646

[22] Filed: Sep. 14, 1992

Related U.S. Application Data

[62] Division of Ser. No. 641,885, Jan. 16, 1991, Pat. No. 5,147,068.

[51] Int. Cl.[5] ..... H05B 6/68

[52] U.S. Cl. ..... 219/717; 219/678; 221/150 A; 235/485

[58] Field of Search ..... 219/10.55 R, 10.55 E, 219/10.55 B; 221/150 A; 426/234, 107, 243; 235/485, 486, 484, 483

[56] References Cited

U.S. PATENT DOCUMENTS

| | | | |
|---|---|---|---|
| 1,728,454 | 9/1929 | Sterling | 221/301 |
| 2,820,127 | 6/1958 | Argento et al. . | |
| 3,333,666 | 8/1967 | Murray et al. . | |
| 3,386,550 | 6/1968 | Murray et al. . | |
| 3,482,509 | 12/1969 | Gardner . | |
| 4,323,773 | 4/1982 | Carpenter | 219/10.55 R |
| 4,349,714 | 9/1982 | Tamano . | |
| 4,398,651 | 8/1983 | Kumpfer | 219/10.55 B |
| 4,592,485 | 6/1986 | Anderson et al. . | |
| 4,677,278 | 6/1987 | Knoll . | |
| 4,771,913 | 9/1988 | Johndrow et al. . | |
| 4,780,588 | 10/1988 | Edamura | 219/10.55 B |
| 4,801,017 | 6/1989 | Artusi . | |
| 4,865,515 | 9/1989 | Dorner et al. | 221/297 |
| 4,924,048 | 5/1990 | Bunce et al. | 219/10.55 E |
| 5,011,042 | 4/1991 | Bunce et al. | 219/10.55 R |

FOREIGN PATENT DOCUMENTS

| | | | |
|---|---|---|---|
| 750215 | 1/1967 | Canada . | |
| 2611465 | 9/1988 | France . | |
| 0026000 | 1/1990 | Japan . | |
| 2-133711 | 5/1990 | Japan | 219/10.55 M |
| 0100791 | 9/1990 | Japan . | |
| 2217558 | 10/1989 | United Kingdom . | |

*Primary Examiner*—Philip H. Leung
*Attorney, Agent, or Firm*—Ostrager, Chong & Flaherty

[57] ABSTRACT

An automated food vending system includes a vending machine having a plurality of stacks and dispenser mechanisms for dispensing standardized food package units, a microwave oven having a code reader located in a predetermined position in an interior cavity of the oven, and the food package units having standardized shapes corresponding to the vending stacks and to the microwave oven cavity. The food packages have a code for controlling the microwave oven printed in a predetermined position which is readable automatically by the code reader when the package unit is inserted in the oven. The dispenser mechanism has a configuration which allows it to be installed in existing vending machines for canned beverages. It may be formed as a pair of pivotable holding members spaced apart in the widthwise direction of the holding stack, or as a pair of continuous belts spaced apart in the depthwise direction of the holding stack. The interior of the oven may be shaped to hold two or more different standardized package shapes, and can have a drive element for controllably moving the package past the code reader. The food package is formed with a quadrangular-sided tray portion and a rectangular, laterally projecting lip around the upper edges of the tray portion, and has the code printed extending in a linear direction. Alternatively, the food package unit is formed with a cylindrical shape and has the code printed extending in a circumferential direction.

8 Claims, 6 Drawing Sheets

AUTOMATED FOOD VENDING SYSTEM

This is a divisional U.S. patent application from the prior application Ser. No. 07/641,885, filed on Jan. 16, 1991, entitled "Automated Food Vending System", now issued as U.S. Pat. No. 5,147,068.

FIELD OF THE INVENTION

This invention generally relates to a food vending system, and particularly to a system which is integrated with an oven for providing hot food service.

BACKGROUND ART

Fast food and convenience food services are a large industry that is continuing to grow in response to increasing demand for provision of food to large numbers of people in shorter and shorter service times. With the high costs of store space and labor, it is very desirable to have automated food vending systems which are reliable in operation and can provide customers a wide range of choices in types of food. Such vending systems can also expand the reach of the fast food industry into locations which are less suitable for standard retail store franchises, such as in company cafeterias, schools, hospitals, airports, gas and roadside stations, hotels and motels.

Some major disadvantages with conventional automated food vending systems have been the lack of an efficient capability to provide hot foods, and the high costs of current machinery for selling fresh foods or freshly-cooked foods. Current vending machines for fresh foods typically have a large enclosed frame, rotating (s) to display the foods to the customers, and a large door or number of doors to allow access to the selected foods. The machinery is therefore mechanically complex and costly, requires a large amount of floor space, can hold only limited capacities of food units, and requires frequent maintenance and reloading. In order to keep the food from spoilage, conventional vending machines are limited to cold foods or snack foods which may contain high levels of preservatives or which may be unappealing to a wide range of customers. The foods obtained from vending machines can be cooked in a microwave oven installed in the vending area, but the provision of cooking facilities takes up additional floor space and requires frequent cleaning. Also, customers often lack the time or knowledge to operate a microwave oven for optimal cooking results.

Some proposals have been made for vending machines which are less costly, can hold larger numbers of food units, and have mechanisms for delivery to an attached microwave oven. For example, U.S. Pat. No. 4,771,913 to Johndrow et al. discloses a vending machine having stacks of food packages and a dispenser mechanism which dispenses a package vertically downward into a microwave oven section that is accessed through a pivoting gate. U.S. Pat. Nos. 3,333,666 and 3,386,550 to Murray et al., U.S. Pat. No. 3,482,509 to Gardner, U.S. Pat. No. 4,349,714 to Tamano, U.S. Pat. No. 4,398,651 to Kumpfer, U.S. Pat. No. 4,592,485 to Anderson et al., and U.S. Pat. No. 4,677,278 to Knoll show other combinations of microwave cookers and vending machines.

However, the proposed machines have used specially designed and relatively complex mechanisms for dispensing the food packages and/or delivering them to the associated microwave ovens. Machines having a fairly complex delivery path are subject to high rates of jamming and mechanical breakdown. It would be highly desirable to employ a food vending structure which is very simple and reliable in operation and which can be retrofit or installed in existing types of vending machines which have proven delivery mechanisms.

It would also be desirable to provide a capability for automatically cooking the vended food at different temperatures, cooking cycles, or time periods. Some prior proposals have been made for selective control of a microwave oven using preprogrammed bar codes. For example, U.S. Pat. No. 4,323,773 to Carpenter and U.S. Pat. No. 4,780,588 to Edamura disclose microwave ovens having an attached wand or scanner for scanning printed bar codes or a plug-in program unit. However, these systems require preprogramming of the microwave oven control or frequent reprogramming if the types of foods are to be changed. Also, if the customer is required to manipulate of the bar code input for the microwave oven control, there is a risk of an unacceptably high level of incorrect operation and inconvenience to the customer. Therefore, it is desirable to have microwave cooking facilities for vended foods which require a minimum of intervention from customers.

SUMMARY OF THE INVENTION

It is therefore a principal object of the invention to provide an automated food vending system having hot food capability which is low in cost, has capacity for handling a large number of food units, and is very simple and reliable in operation. It is a specific object of the invention that such a system can be retrofit or installed in existing types of vending machines which have proven delivery mechanisms. It is a further object to provide the capability for automatic cooking of vended food at different temperatures, cooking cycles, or time periods without requiring any machine preprogramming or reprogramming, and without incorrect operation or inconvenience to the customer.

In accordance with a main aspect of the invention, an automated food vending system has holding means including a plurality of stacks for holding respective stacks of food package units, a dispenser mechanism for dispensing a food package unit from any selected one of the holding stacks to a dispenser outlet, a microwave oven having a code reader located in a predetermined position in an interior cavity of the oven, and the food package units having a code for controlling the microwave oven printed thereon in a predetermined position which is readable automatically by the code reader when the selected package unit is taken from the dispenser outlet and inserted in the oven. A preferred feature of the system is that each food package unit has a standardized package shape, and the interior cavity of the microwave oven has a shape which matches the standardized shape so that the package unit is held in a predetermined position by the shape of the oven cavity. The interior of the oven may be shaped to hold two or more different standardized package shapes. The code reader may be a bar or magnetic code or optical character reader for reading the code printed on the package.

Another aspect of the invention is the provision of a dispenser mechanism which can be retrofit or installed in existing types of vending machines which have proven delivery mechanisms. Conventional vending machines for dispensing soft drink cans have a plurality of holding stacks each having a predefined width in a widthwise direction and a predefined depth in a depthwise direction of the machine, dispenser mechanisms provided at a bottom portion of respective ones of the holding stacks, and drive elements for operating the respective dispenser mechanisms in accordance with customer selection. The invention provides a system for retrofitting such conventional vending machines for food packages, wherein a dispenser mechanism is used having a pair of holding members spaced apart in parallel on each side of the width of the stack, each holding member having a pair of flanges at a right angle to each other for holding and dispensing the food containers by a reciprocating pivotal movement, and the holding members having pivot axes which coincide with the sides of the stacks.

As an alternate embodiment, the dispenser mechanism is formed by a pair of continuous belts spaced apart in parallel on opposite vertical sides of the respective stack in a depthwise direction of the machine, wherein pair of belts each has a plurality of catch members disposed at correspondingly spaced positions thereon for holding and dispensing each food package unit in succession from the stack by intermittent belt movement in a dispensing direction. The pitch between catch members corresponds to the spacing between packages.

Both embodiments of the dispenser mechanism can readily be retrofit to standard soft drink vending machines. These machines have parallel holding stacks of a predefined width for holding double rows of soft drink cans and a dispenser mechanism of the flip-flop or paddle type. The flip-flop dispenser can be replaced with either of the two embodiments of the invention. No modification to the vending machine is required because the dispenser mechanisms do not take up any additional width and operate within the predefined stack width.

As a further aspect of the invention, a microwave oven is provided for use in combination with vended food package units having a standardized package shape and a code for controlling a microwave oven printed thereon in a predetermined position. The oven has an interior cavity which is shaped to match the standardized package shape so that each package unit is held in a predetermined position in the oven cavity, and a code reader is located in a predetermined position in the oven cavity such that the code printed on the food-package unit is readable automatically by the code reader when the package unit is inserted in the oven. The interior of the oven may be shaped to hold two or more different standardized package shapes. The microwave oven may include a drive element for controllably moving the package constrained by the shape of the oven cavity along a linear direction (for a tray package) or rotationally (for a cylindrical package) so that the printed code field can be moved past the code reader. Alternatively, the code reader may be moved.

Still a further aspect of the invention encompasses a food package unit comprising walls defining a hollow, quadrangular-sided tray portion, a rectangular, laterally projecting lip around the upper edges of the tray portion, and a code for controlling a microwave oven printed at a predetermined position on the package unit, so that it can be scanned by a code reader positioned adjacent the code in the oven. The projecting lip allows the package unit to be held and/or dispensed in a vending machine by retaining it from opposed lateral sides. The package unit is intended for use in a microwave oven having an interior cavity shaped to receive the opposed projecting lateral sides of the package unit. The code may be printed on the opposed lateral sides of the projecting lip. In an alternate embodiment, the food package unit has a cylindrical shape and the code printed at a predetermined position on an outside surface of the cylindrical shape extending in a circumferential direction, so that it can be scanned by a code reader upon circumferential rotation of the package unit.

Other objects, features and advantages of the present invention will be apparent from the following detailed description of the preferred embodiments with reference to the drawings, of which:

DETAILED DESCRIPTION OF THE INVENTION

Figure 2:
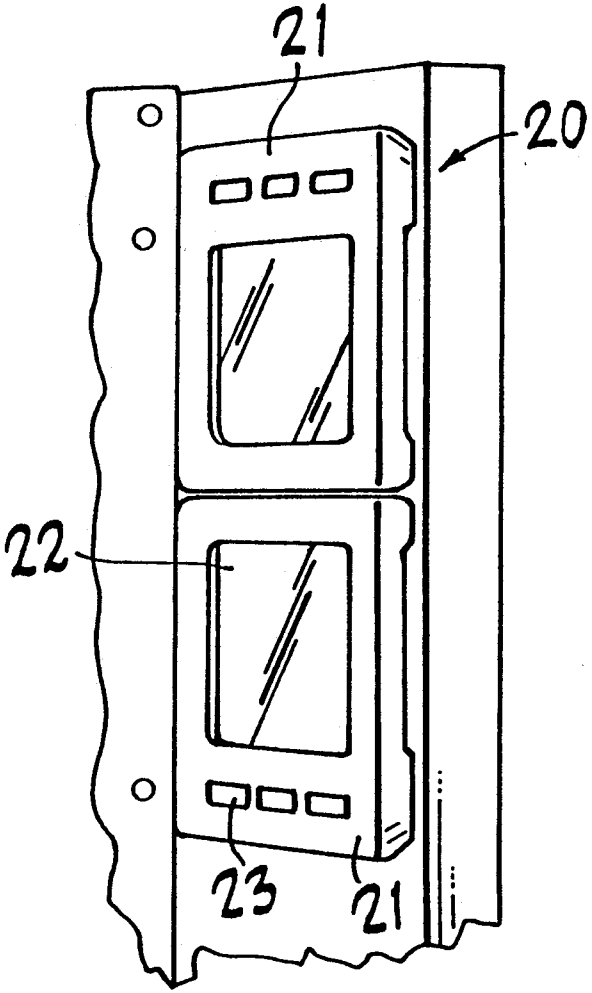
FIG. 2 is a close-up view of a microwave oven assembly in the automated food vending system of FIG. 1.
Figure 1:
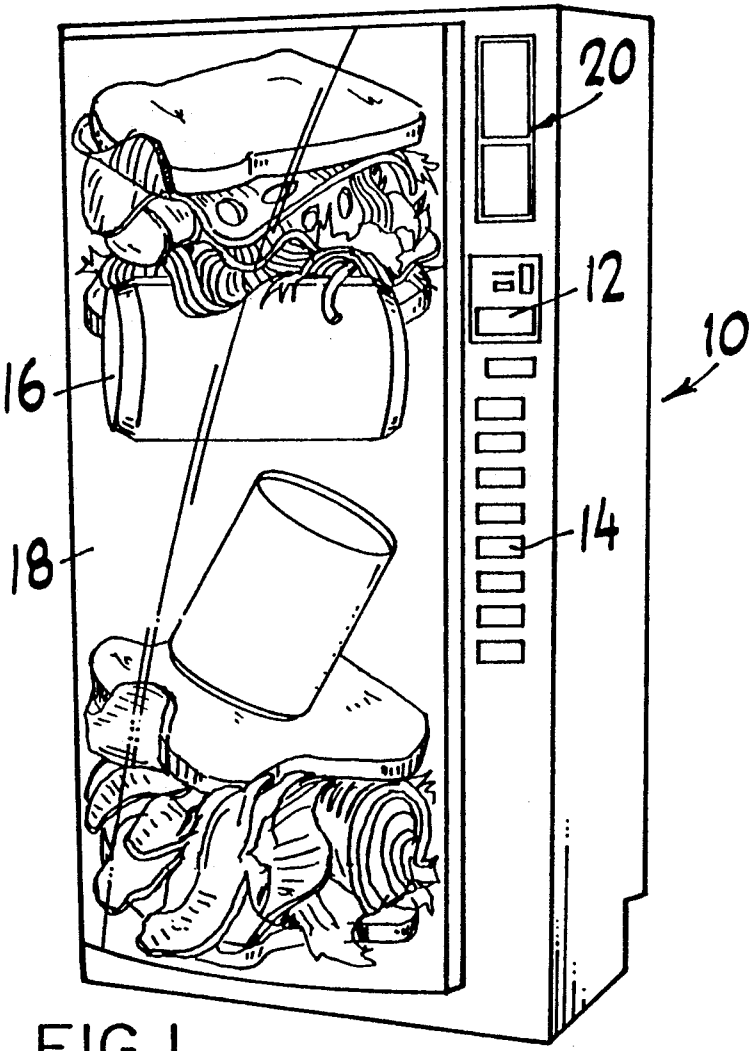
FIG. 1 is a perspective view of an automated food vending system having the capability for hot food service and using a standard vending machine structure in accordance with the principles of the invention.
Figure 3:
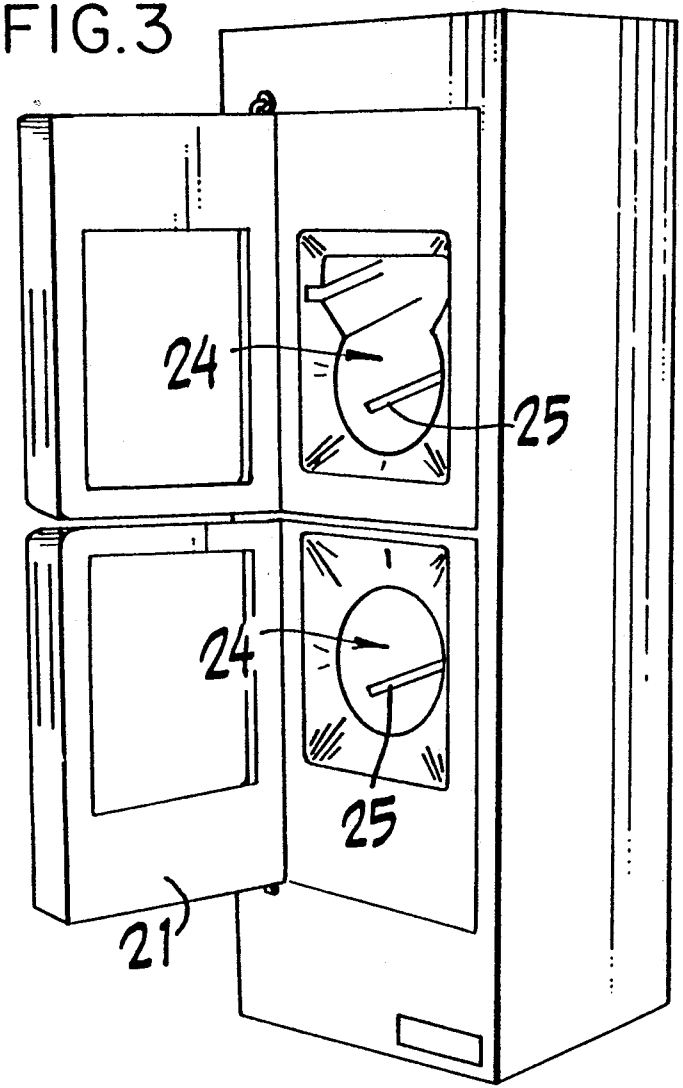
FIG. 3 is a further detailed view of the microwave oven assembly of FIG. 2 showing the interior shaped cavities for receiving standardized package shapes therein.

Referring to FIGS. 1–3, an automated food vending system in accordance with the invention has an exterior chassis 10 in which a plurality of holding stacks for food package units are contained, a dispenser mechanism including a payment mechanism 12, selector controls 14, and a dispenser outlet 16 for dispensing a selected food package selected from the holding stacks, a front door 18 for allowing access to the interior of the chassis for reloading the holding stacks or for repairs or maintenance, and an oven 20 for heating a food package to provide hot food service. The most practical form of oven is a microwave oven. The system of the invention will be described with respect to a microwave oven, although it is to be understood that the principles of the invention may be similarly applied to other types of ovens, such as convection, combined microwave/convection, hot plate, etc. For an aesthetically pleasing display, the front door can contain a transparent sheet of artwork which is illuminated from behind, as is well known in the industry.

The microwave oven 20 includes a front door 21 which may have a viewing or display window 22 therein, indicator lights 23 which may consist of three LED lights to indicate whether the oven is vacant, in use, or completed with the cooking cycle. In the system shown, the oven includes two microwave oven units for heating two package units at once or two different types of packages, or as a backup. Of course, the system may be configured with a single unit or with an additional number of units. The interior of the microwave oven has a shaped cavity 24 which is specifically shaped to receive a correspondingly shaped food package. In accordance with the invention, each food package unit has a standardized package shape, and the interior cavity of the microwave oven has a shape which matches the standardized shape so that the package unit is held in a predetermined position in the oven. The cavity 24 may have a shape for only one type of package unit, or it may receive a plurality of package shapes. The cavity 24 has one or more code readers 25 located in a predetermined position so that codes for controlling the microwave oven printed on the food packages are readable automatically by the code reader when the package unit is inserted in the microwave oven. The code reader 25 may be a bar or magnetic code or optical character reader.

Figure 4:
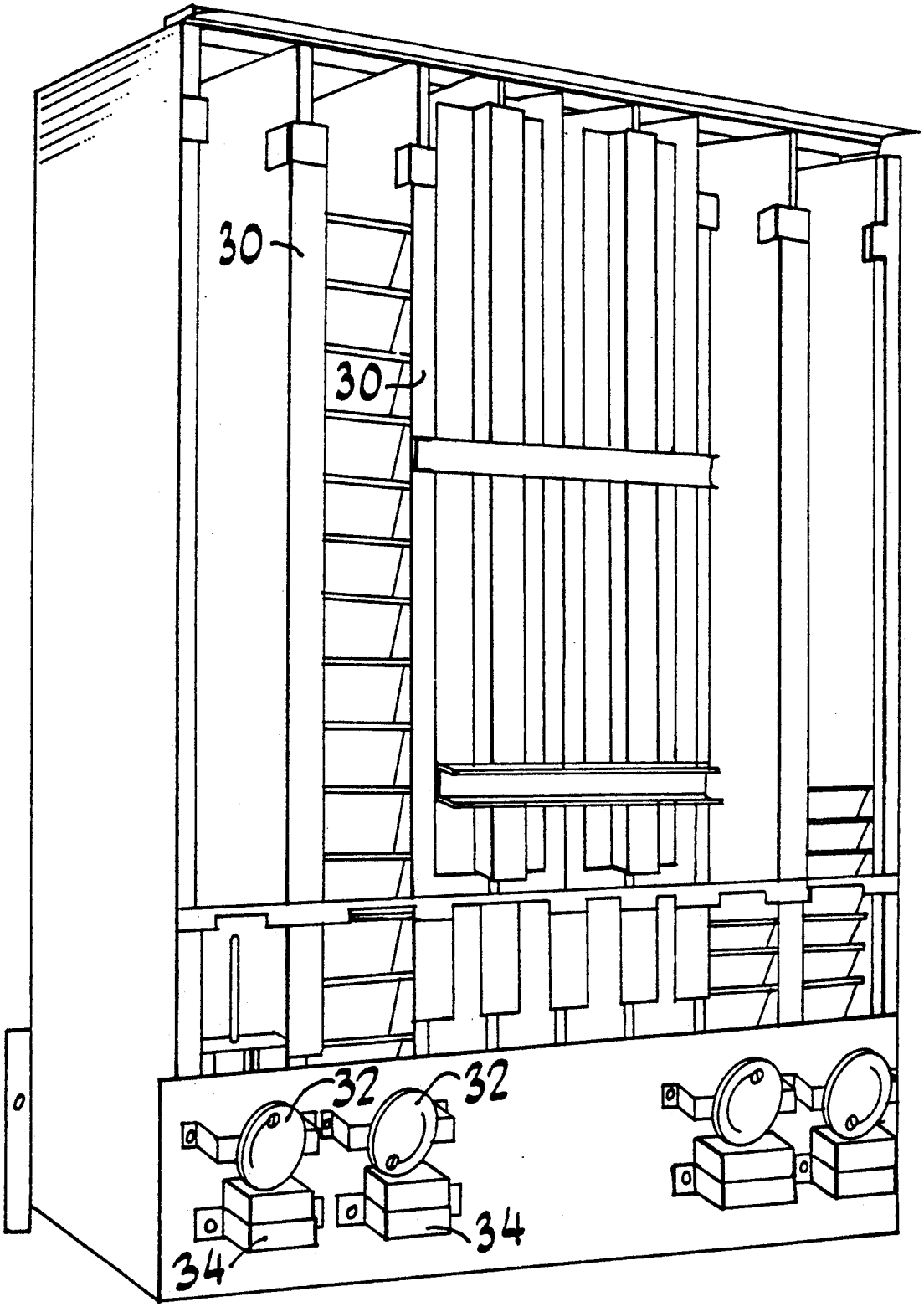
FIG. 4 shows an internal view of the standard vending machine structure of FIG. 1 having a dispenser mechanism installed therein in accordance with another aspect of the invention.

In FIG. 4, the holding stacks of the vending system are shown as being formed by vertical dividers or separator panels 30 which are fixed to the frame of the chassis 10 at predetermined width spacings. Food packages of the corresponding widths are stacked in each holding stack defined by each adjacent pair of dividers 30. Dispenser mechanisms 32 are provided at a bottom portion of the respective holding stacks for dispensing a food package unit from a selected stack to the dispenser outlet 16, and drive elements 34 are provided for selectively operating the respective dispenser mechanisms.

A main feature of the invention is the provision of a dispenser mechanism which can be retrofit or installed in existing types of vending machines which have proven delivery mechanisms. A conventional type of vending machine is widely used for vending soft drinks and juices packaged in standardardized 12-ounce aluminum cans. Such vending machines are manufactured by Maytag Corporation, of Cincinnati, Ohio, and the construction and operation of these machines are widely known throughout the industry. As shown in FIG. 4, these standard soft drink vending machines have proven delivery mechanisms in the form of holding stacks having a predefined width holding double rows of soft drink cans, dispenser mechanisms of the flip-flop or paddle type which flips from one side to the other to release cans alternately from the double rows of cans, and an exit chute at a bottom portion of the chassis.

In the invention, standardized packages are used which have the same overall width as the double-row width spacings used for these soft drink vending machines. Thus, the flip-flop dispensers can then be replaced with a dispenser mechanism adapted to the food package units without the need for making any substantial modifications to the remainder of the vending machine, except for perhaps the drop path and shape of the dispenser outlet.

Figure 5:
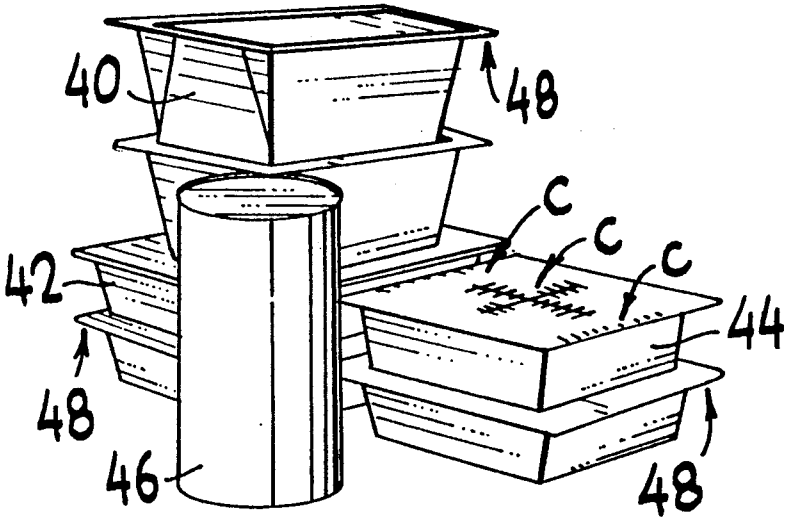
FIG. 5 illustrates some standardized food package shapes for use in the system automated food vending of the invention.

Examples of standardized food package shapes used in the invention are shown in FIG. 5, including a deep rectangular tray package 40 having a deep tray, a long rectangular tray package 42 having a shallow tray and the same width but a longer length than the package 40, and a short rectangular tray package 44 having a shallow tray and the same width but a shorter length than the package 40. The trays all have a laterally projecting upper lip or lid 48, which is used for dispensing the packages and for positioning them in the microwave oven, as described in further detail hereinafter. The trays are made of ovenable laminates of paperboard, plastic film, and/or microwave suceptor film, which are commercially available. Examples of ovenable packages having a vendable edge are available from Westvaco Corp. In the invention, a bar, magnetic, optical character or other type of code for controlling the microwave oven is printed on the tray package, such as on the upper surface of the lid 48 or along one or both lateral sides of the laterally projecting lip or edge of the lid 48.

A cylindrical package 46 may also be used in the vending system of the invention. For example, the cylindrical package may have a diameter which may be the same as that of a standard soft drink can, so that it can be used in the conventional double-row soft drink vending machine without modification of the machine. The length of the cylindrical package may made be longer that of the soft drink can for holding greater food content. For example, the cylindrical package may be used soups, hot drinks, etc. The cylindrical packages are also made of ovenable laminates, and may be provided with vapor pressure release mechanisms for venting upon heating. The oven control code is printed on the outside surface of the package, with the code field extending either in the lengthwise or in the circumferential direction.

Figure 6:
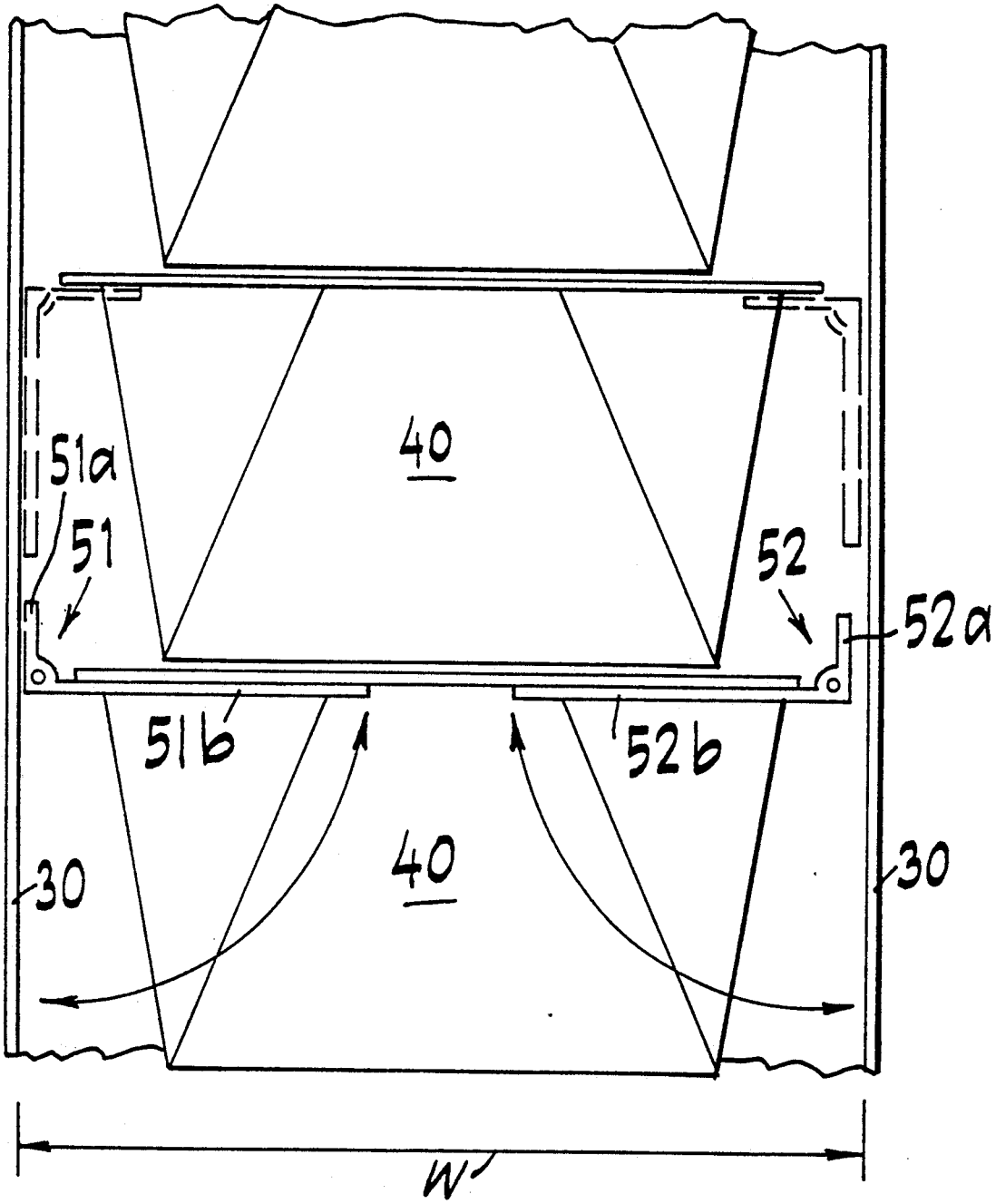
FIG. 6 shows a schematic side view of one embodiment of a dispenser mechanism of the invention for rectangular food packages.
Figure 7:
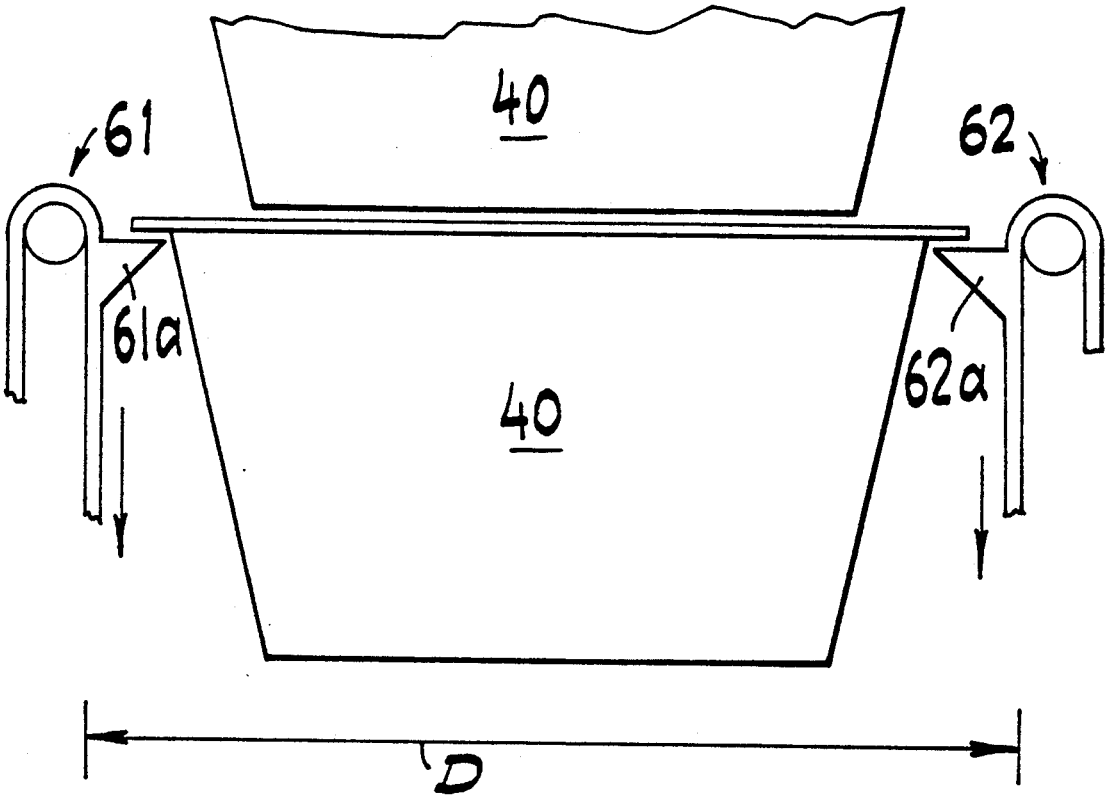
FIG. 7 shows a schematic side view of another embodiment of a dispenser mechanism of the invention.

FIGS. 6 and 7 show two embodiments of dispenser mechanisms which can be retrofit to the standard soft drink vending machines for dispensing food trays in accordance with the invention. The dispenser mechanisms are designed so that they do not take up any additional width and can operate within the predefined stack widths of the standard soft drink vending machines. In the embodiment of FIG. 6, the dispenser mechanism includes a pair of holding members 51 and 52 which are spaced apart in parallel on each side of the width W between the dividers 30 of the stack. Each holding member has a pair of flanges 51*a*, 51*b* and 52*a*, 52*b* which are at right angles to each other and which have a width corresponding to the width of the laterally projecting lip of the trays to be dispensed. The holding members are turned back and forth in reciprocating pivotal movement, indicated by the double-headed arrows. Movement of the holding members through 90 degrees allows the lower flanges to release a lower tray and the upper flanges to catch an upper tray, as shown in phantom lines. When the holding members are reciprocated back 90 degrees, the upper flanges first raise then release the remaining stack of trays, and the lower flanges then retain the stack by holding the lip of what was the upper tray as the next tray to be vended, as shown in the drawings in heavy black lines. The holding members are pivoted by linkages to a rotary cam portion of the dispenser mechanism (visible in FIG. 4), and the rotary cars are driven by the motor drive elements 34. The pivot axes of the holding members coincide with the sides of the stacks, and therefore require no additional width between the dividers 30 for installation. Alternatively, the pivotable holding members may be arranged in the depthwise direction of the stack.

In the embodiment of FIG. 7, the dispenser mechanism is formed with a pair of continuous belts 61, 62 which, are spaced apart a distance D in parallel on opposite vertical sides of the respective stack in a depthwise direction of the machine chassis. Each belt has a plurality of catch members 61a and 62a at correspondingly spaced positions for dispensing each food package unit by intermittent belt movement in the dispensing direction indicated by the arrow in the drawing. The catch members are spaced at pitches corresponding to the height spacings of the packages, so that as the belt is advanced downward to release a lower tray 40, the succeeding catch member is advanced in time to project under the lid or lip 48 of the next tray. Since the belts are installed at the vertical sides in the depthwise direction of each stack, no additional width is required between the dividers 30 for installation.

Figure 9:
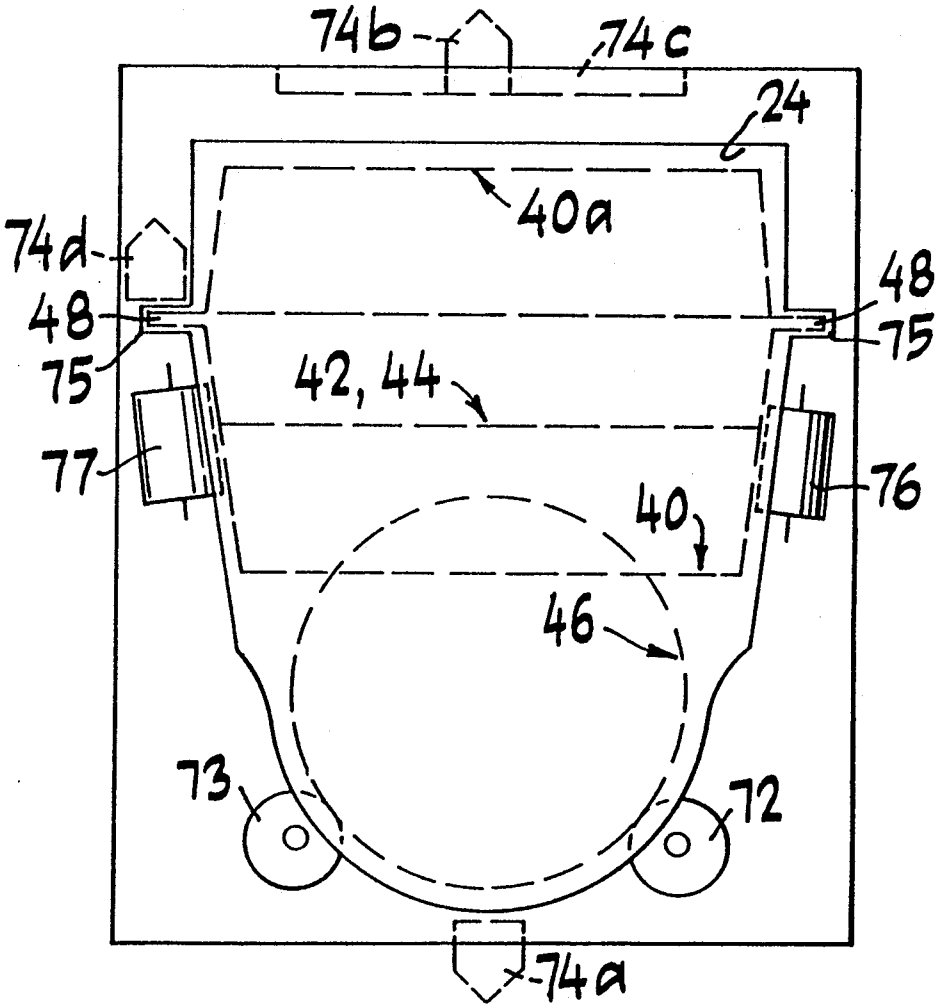
FIG. 9 shows a schematic side view of another embodiment of a microwave oven having a shaped interior cavity for a plurality of standardized package shapes.
Figure 8:
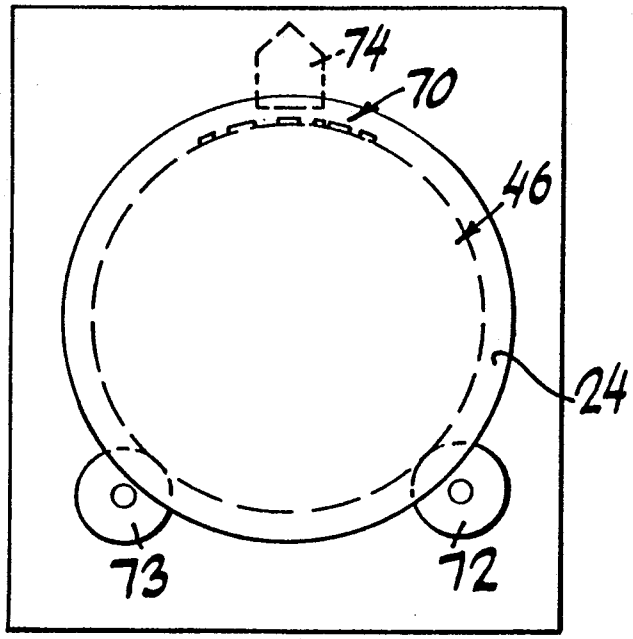
FIG. 8 shows a schematic side view of one embodiment of a microwave oven having a shaped interior cavity in accordance with a further aspect of the invention.

In FIGS. 8 and 9, two embodiments for the microwave oven units are shown for use in combination with vended food package units having standardized package shapes and codes for controlling the microwave oven printed thereon as illustrated in FIG. 5. The microwave ovens have interior cavities which are matched to the standardized package shapes so that each package unit can be inserted and held in a predetermined position in the oven, and a code reader located at a predetermined position in the cavity of the oven so as to read the code printed on the food package unit. In FIG. 8, the microwave oven has an interior cavity 24 in a cylindrical shape for holding a cylindrical package 46. The code 70 is shown printed in a circumferential direction on the outer surface of the package. A pair of rollers 72, 73 are used to drive the package in rotational movement at least one complete circumference of the package so that the code can be completely read by the reader 74 no matter what position the package is inserted in the cavity. The code may start with initial bits indicating which is the leading end and trailing end of the code field so that the code can be properly decoded from either direction. Instead of moving the package, the reader can also be arranged to traverse the package in the circumferential direction or, alternatively, in the lengthwise direction.

In FIG. 9, the microwave oven has an interior cavity 24 which is shaped to hold two or more different standardized package shapes. For example, the cavity 24 can hold a cylindrical package 46 at its lower, curved portion, and any of the rectangular trays 40, 42, 44 at its upper portion, using the recesses 75 to hold the lids 48 of the trays. The cavity 24 can also accomodate a rectangular tray having an added-height cover 40a. Drive rollers 76, 77 are provided for controllably moving the rectangular tray packages, constrained by the interior shape of the oven cavity, along a linear direction (depthwise direction), and drive rollers 72, 73 are used to rotate the cylindrical package in the circumferential direction. The code reader 74a is provided at the bottom portion of the cavity for reading the cylindrical package. For the rectangular trays, the code reader 74b may be placed in a fixed centerline position while the tray is driven in the depthwise direction, or the reader 74c may be arranged to move laterally across the upper surface of the lid at a centered code position. Alternatively, the code reader 74d may be arranged at one of the side recesses 75 to read a code printed on the lateral edges of the lid 48.

The printed code is preferably in the form of bar code which can be read reliably by a bar code reader. The printed code contains code elements for controlling the operation of the microwave oven, as is well known in this field. Such codes can control the power level, time, and sequence for one or more heating cycles. For example, if the vending machine contains frozen fried foods in microwave susceptor packages, the codes can control a defrosting cycle, followed by a cooking cycle, followed by a crisping cycle. The package code may alternatively be printed as magnetic or optical code.

The printed code may also include elements specifying an expiration date, and the vending system may have a clock unit and a lockout element activated by detection of a date past the expiration date for locking the microwave oven from cooking. Alternatively, the date code elements may be read by code readers positioned adjacent the stacks of the vending machine in order to lock out the dispenser mechanisms for one or more of the stacks. The package code may also include a package or source identification number for tracking purposes.

The code or its label may also be printed with an ink or dye material which changes color upon exposure to microwave cooking (to indicate that the package has already been cooked once). For example, the label on which the control code is printed may have a dye which turns black upon exposure to microwave radiation, thereby preventing the code from being read a second time. Such ink or dye materials are well known to those skilled in this field.

The vending machine may have conventional coin or bill payment mechanisms 12, and also card payment mechanisms such as those offered by Verifone Systems, of Honolulu, Hi. A microprocessor and display may be provided in conjunction with the selection and payment mechanisms, so that different food items may be variably priced. The pricing of the food selections is programmed into the payment mechanism memory and displayed according to a customer selection, and the dispenser mechanism is actuated upon receipt of proper payment.

As further refinements, the food package may have a steam-pressure release in the form of a non-wetting, water-vapor-permeable fabric, such as Goretex TM synthetic fabric, for sealing a portion of the package. The food package may also have a closure release in the form of a membrane sealed to the package with an adhesive which releases upon exposure to microwave cooking (to allow easy opening of the package). A transparent window may be provided in the package cover to allow one to visually inspect the food contained therein before and after cooking. A two-part longitudinal food package may also be provided in which the cold food part is separable from the hot food part by a perforation line in the transverse direction for a meal having both hot and cold portions. In a refrigerated vending machine, an electrical fault detector may be provided to detect if the electric power supply for the refrigeration unit has been off for longer than a predetermined time indicating food spoilage, and can thus lock the dispenser mechanisms from dispensing possibly spoiled foods.

The automated food vending system of the invention facilitates the machine vending of all types of foods. The dispenser mechanisms are readily retrofit to the conventional, widely used, soft drink vending machines. The package-specific oven configuration and control by codes printed on each package eliminates the possibility of incorrect operation by the customer and greatly improves customer convenience by automatically programming the oven for the optimal cooking sequence. Since the microwave oven only requires a cavity for handling dispensed packages, it can be made in a compact size and installed within the chassis of the machine. The vending machine/oven combination can be placed in a wide range of fast food, cafeteria, hotel, transportation, and institutional environments. The microwave oven and coded packages may also be used in environments other than a vending machine. For example, the oven may also be installed in the door of a refrigerator for home use. The vendable edge may be provided on food packages of other than a rectangular tray shape. For example, a mounting board, having a width corresponding to the width of the dispenser stacks and/or the microwave oven cavity, can be used to provide a vendable edge for other types of containers. The mounting board may have a round or polygonal mounting aperture in which a correspondingly shaped container having inclined sides is inserted and held by friction fit.

Although the invention has been described with reference to certain preferred embodiments, it will be appreciated that many variations and modifications nay be made consistent with the broad principles of the invention. It is intended that the preferred embodiments and all of such variations and modifications be included within the scope and spirit of the invention, as defined in the following claims.

I claim:

1. A microwave oven, for use in combination with food package units having a predetermined three-dimensional shape and a code for controlling the microwave oven printed in a predetermined position thereon, comprising:

an interior cavity having a shape which matches the predetermined three-dimensional package shape so that each package unit is held in a predetermined position in the oven cavity;

a door at a front portion of the microwave oven which is openable to allow insertion of a food package unit into the interior cavity of the oven, and a code reader located in a predetermined position in the interior cavity such that the code printed on the food package unit is readable automatically by the code reader when the package unit is inserted in the oven cavity, said interior cavity having interior walls defining its shape to correspond to the predetermined shape of the food package units such that the shaped interior cavity functions to constrain insertion of a correspondingly-shaped food package unit therein to substantially one degree of freedom of insertion movement, and said code reader being located in the predetermined position in the interior cavity so as to be positioned for reading a predetermined portion of the food package unit when it is inserted in the interior cavity constrained to the one degree of freedom of insertion movement.

2. A microwave oven according to claim 1, wherein the interior cavity of the oven is shaped to hold two or more different predetermined package shapes.

3. A microwave oven according to claim 1, further comprising a drive mechanism projecting into the interior cavity of the microwave oven for moving a package unit inserted in said interior cavity along one direction of movement in the interior cavity so as to move an entire field of the printed code on the package past the code reader.

4. A microwave according to claim 1, wherein the code reader is selected from the group comprising a bar code, a magnetic code, and an optical character reader for reading the code correspondingly printed on the package unit.

5. A method of using a food package unit for automatic programming of microwave oven having a code reader to cook the food package unit, comprising the steps of:

providing a food package unit having walls defining a hollow, quadrangular-sided tray portion, a rectangular, laterally projecting lip around the upper edges of the tray portion, and a code for controlling the microwave oven printed at a predetermined position on an outside surface of the package unit extending in a linear direction, said code being printed at a predetermined position on the package unit, so that it can be read by a code reader positioned adjacent the code in the oven cavity as the package unit is driven in the linear direction, providing a microwave oven having a door at a front portion thereof which is openable to allow insertion of the food package unit into an interior cavity of the oven, the interior cavity having interior walls defining a shape corresponding to and adapted to have the quadrangular-sides and laterally projecting lip of the food package unit inserted therein, said shaped interior cavity thereby constraining the insertion of the correspondingly-shaped food package unit to substantially one degree of freedom of insertion movement, and a code reader located in a predetermined position in the interior cavity corresponding to the predetermined position of the code printed on the food package unit, and inserting the food package unit into the interior cavity of the oven wherein its insertion movement is constrained by the shaped walls of the interior cavity so that the printed code in the predetermined position on the food package unit is readable automatically by the code reader in the corresponding predetermined position.

6. A method of using a food package unit according to claim 5, wherein said code is printed on a lateral side of the projecting lip of the food package unit, and said code reader is positioned in the interior cavity of the oven at the predetermined position corresponding to said lateral side of the projecting lip of the food package unit.

7. A method of using a food package unit according to claim 5, wherein the printed code is selected from the group comprising bar code, magnetic code, and optical characters.

8. A method of using a food package unit for automatic programming of a microwave oven having a code reader to cook the food package unit, comprising the steps of:

providing a food package unit having walls defining a cylindrical shape, and a code for controlling the microwave oven printed at a predetermined position on an outside surface of the cylindrical shape extending in a circumferential direction, so that it can be read by a code reader positioned adjacent the code in the oven cavity as the cylindrical package unit is driven in circumferential rotation, providing a microwave oven having a door at a front portion thereof which is openable to allow insertion of the food package unit into an interior cavity of the oven, the interior cavity having interior walls defining a shape corresponding to and adapted to have the cylindrical food package unit inserted therein, said shaped interior cavity thereby constraining the insertion of the correspondingly-shaped food package unit to substantially one degree of freedom of insertion movement, a drive means for driving the cylindrical food package unit inserted in the interior cavity in circumferential rotation, and a code reader located in a predetermined position in the interior cavity corresponding to the predetermined position of the code printed on the food package unit, and inserting the food package unit into the interior cavity of the oven wherein its insertion movement is constrained by the shaped walls of the interior cavity so that the printed code in the predetermined position on the food package unit is readable automatically by the code reader in the corresponding predetermined position when the package unit is inserted in the oven's interior cavity and driven by the drive means in circumferential rotation.

* * * * *